United States Patent [19]

Herd, Jr. et al.

[11] 4,283,355

[45] Aug. 11, 1981

[54] CARBURETOR

[75] Inventors: William H. Herd, Jr., Fresno; Stanley F. Curtis, Exeter; Vernon T. Mullican; Robert W. Jones, both of Porterville, all of Calif.

[73] Assignee: Pollution Controls Industries, Inc., Tulare, Calif.

[21] Appl. No.: 78,568

[22] Filed: Sep. 24, 1979

[51] Int. Cl.[3] ..... F02M 7/22

[52] U.S. Cl. ..... 261/44 F; 261/50 A; 261/78 R; 261/DIG. 39; 261/DIG. 56; 74/568 R; 261/DIG. 6

[58] Field of Search .... 261/78 R, DIG. 39, DIG. 56, 261/44 F, 50 A; 74/568 R

[56] References Cited

U.S. PATENT DOCUMENTS

| | | | |
|---|---|---|---|
| 1,143,779 | 6/1915 | Pembroke . | |
| 1,429,534 | 9/1922 | Renner . | |
| 1,510,366 | 9/1924 | Whiteman . | |
| 1,547,296 | 7/1925 | Bullard | 261/DIG. 56 |
| 1,893,920 | 1/1933 | Winfield . | |
| 2,236,595 | 4/1941 | Fish . | |
| 2,307,214 | 1/1943 | Gollmer | 74/568 R |
| 2,478,500 | 8/1949 | Parsons | 74/568 |
| 2,551,792 | 5/1951 | De Giers et al. | 74/568 R |
| 2,855,283 | 10/1958 | Schumacher | 261/50 A |
| 3,044,751 | 7/1962 | Sarto | 261/44 F |
| 3,069,146 | 12/1962 | MacNeill | 261/44 F |
| 3,182,974 | 5/1965 | Hill | 261/44 F |
| 3,249,346 | 5/1966 | Bickhaus et al. . | |
| 3,342,462 | 9/1967 | Mick . | |
| 3,347,536 | 10/1967 | Sutton | 261/DIG. 39 |
| 3,664,648 | 5/1972 | Seeley, Jr. | 261/78 R |
| 3,695,589 | 10/1972 | Lamore | 261/50 A |
| 3,706,438 | 12/1972 | Condon et al. | 74/568 R |
| 3,752,451 | 8/1973 | Kendig | 261/50 A |
| 3,969,445 | 7/1976 | Vogelsang | 261/44 F |
| 4,021,513 | 5/1977 | Ullman | 261/DIG. 56 |
| 4,056,583 | 11/1977 | Shinoda et al. | 261/DIG. 56 |

FOREIGN PATENT DOCUMENTS

| | | | |
|---|---|---|---|
| 77094 | 1/1948 | Czechoslovakia | 261/DIG. 56 |

OTHER PUBLICATIONS

Brimm et al., Aircraft Engine Maintenance, Pitman, 1939, pp. 170–172.

Larew, Carburetors and Carburetion, Chilton, 1967, pp. 155, 156.

*Primary Examiner*—Tim R. Miles

*Attorney, Agent, or Firm*—Huebner & Worrel

[57] ABSTRACT

A carburetor for connection to an internal combustion engine having a housing provided with a mixing passage for the flow of air to the engine; a throttle at the downstream end of the passage; a fuel spray bar extending transversely across the passage upstream of the throttle having transversely oppositely disposed fuel orifices facing the walls of the passage; a pair of venturi plates mounted for pivotal movement about individual axes upstream of the bar and spaced oppositely and transversely from the bar, the plates having distal ends and pivoting between closed, convergent positions in which the distal ends are adjacent to the bar and open positions in which the plates diverge from the bar, thereby defining an adjustable throat; a source of fuel; a conduit interconnecting the orifices and the source; a plunger-actuated valve in the conduit for controlling the flow of fuel from the source; a rotationally mounted cam adjacent to the valve having a cam surface in controlling relation with the valve; and a linkage connecting the plates and the cam for actuation of the valve concurrently with movement of the plates to regulate the air-fuel mixture in the passage.

5 Claims, 12 Drawing Figures

CARBURETOR

BACKGROUND OF THE INVENTION

1. Field of the Invention

The present invention relates to a carburetor for use with an internal combustion engine, and more particularly to such a carburetor which has pivotally mounted venturi plates and is provided with improved elements for discharging fuel into a venturi defined thereby and for coordinating the flow of fuel to be discharged with the position of the plates so that the carburetor provides desired air-fuel mixture ratio through the entire range of air flow required by the engine.

2. Description of the Prior Art

Carburetors having a variable venturi are well known. A carburetor of this type is disclosed in U.S. Pat. No. 3,752,451 to Kendig issued on Aug. 24, 1973, and hereinafter referred to as the "Kendig carburetor". The instant carburetor developed from the Kendig carburetor and efforts to improve its performance.

The Kendig carburetor is characterized by having a housing defining a rectangular mixing passage provided with a throttle at its downstream end, a pair of venturi plates at its upstream end, and a fixed fuel spray bar extending centrally across the passage between these ends. The plates pivot about individual axes adjacent to the walls of the passage toward its upstream end. When in a closed position, the plates extend normally to the passage upstream of the bar with their distal ends engaged at a point substantially upstream of the bar. As the plates pivot from the closed position to an open position they define a venturi between their distal ends which initially is above the bar but moves past it as the plates pivot downwardly to open.

The Kendig carburetor is further characterized by a system for metering fuel from a supply chamber in the housing to orifices in the bar which open into the passage. This system includes a pickup arm which pivots about an axis coincident with the bar. The pivotal movement of the arm is coordinated with pivotal movements of the plates by a train of gears. The arm has a conduit therein between its distal end and the bar. The conduit terminates at the distal end in an opening which moves over a stationary arcuate, concave metering ramp as the arm moves pivotally. The spacing of the ramp from the distal end varies with this movement thus variably restricting the flow of fuel to the orifices with the intention of providing a substantially constant air-fuel mixture ratio.

While the Kendig carburetor constituted a remarkable step forward in the art, it nevertheless has certain problems which the present invention has sought to overcome.

SUMMARY OF THE INVENTION

It is an object of the present invention to provide an improved carburetor which supplies a fuel-air mixture with a desired fuel-air ratio over a wide range of flow of air through the carburetor with the fuel being uniformly distributed in the air.

Another object is to provide such a carburetor utilizing pivoting venturi plates defining a venturi which is advantageously disposed in relation to a fixed spray bar at all positions of the plates.

Another object is to provide such a carburetor having economical and reliable arrangements for coordinating pivotal movement of the venturi plates with the movement of a valve element metering the flow of fuel.

Another object is to provide such a carburetor in which said arrangements also provide extremely precise adjustment of the position of said metering element at a selected position of the plates.

Another object is to provide such a carburetor having pivotally moving venturi plates whose movement is precisely coordinated with that of a fuel metering element so as to provide a desired air-fuel mixture ratio at all positions of the plate and especially at such positions corresponding to relatively low flow of air through the carburetor as during idling.

Another object is to provide such a carburetor having a mixing passage provided with pivotal venturi plates and a fixedly mounted fuel spray bar through which fuel is supplied to the passage, the plates and the bar having improved dispositions and proportions which result in the mixture provided by the carburetor having a desired air-fuel ratio over a wide range of air flow through the passage.

Another object is to provide such a carburetor in which the fuel spray bar is provided with elements for ensuring even air flow thereacross and even distribution of fuel from the bar into the passage at all positions of the plates.

Further objects and advantages are to provide improved elements and arrangements thereof in a carburetor having pivotally mounted venturi plates which converge in a closed position, toward a fixedly mounted fuel spray bar extended between the plates and having a valve which meters fuel to the bar in relation to the position of the plates and is controlled by a pivotally mounted cam, the carburetor providing a desired air-fuel mixture ratio at all positions of the plates and being dependable and fully effective in performing its intended purpose.

PRIOR ART STATEMENT

Characterizing the closest prior art of which the applicant is aware and in compliance with 37 C.F.R. Sections 1.97 and 1.98, attention is invited to the following patents and portions of publications.

U.S. Pat. Nos.

| Inventor(s) | No. | Date |
|---|---|---|
| Pembroke | 1,143,779 | June 22, 1915 |
| Renner | 1,429,534 | Sept. 19, 1922 |
| Whiteman | 1,510,366 | Sept. 30, 1924 |
| Winfield | 1,893,920 | Jan. 10, 1933 |
| Fish | 2,236,595 | April 1, 1949 |
| Mick | 3,342,462 | Sept. 19, 1967 |
| Bickhaus et al | 3,249,346 | May 3, 1966 |
| Kendig | 3,752,451 | Aug. 14, 1973 |

Publications

Brimm, D. J. and Bogges, H. E. *Aircraft Engine Maintenance*, Pitman 1939, p. 170–172.

Larew, W. B. *Carburetors & Carburetion*, Chilton 1967, p. 155–156.

The Kendig U.S. Pat. No. 3,752,464 is believed relevant in its disclosure of a variable venturi carburetor having a mixing passage with venturi plates upstream of a throttle and a spray bar extended transversely across the passage therebetween. This patent is also believed relevant in its disclosure of a variable clearance device to meter fuel to the bar in relation to the position of the venturi plates. The distinctions between this disclosure and the present invention are subsequently described.

The Pembroke U.S. Pat. No. 1,143,779, is believed relevant in its disclosure of a carburetor having venturi plates converging in a closed position to a spray bar and engaging the bar upstream of opposite rows of orifices. The spray bar, however, is not fixed but moves downstream as the plates open.

The Renner U.S. Pat. No. 1,429,534; the Whiteman U.S. Pat. No. 1,510,366; and the Mick U.S. Pat. No. 3,342,462, disclose variable venturi carburetors having venturi plates converging in closed positions to fuel discharge orifices. However, the orifices are disposed centrally of the mixing passages rather than along a spray bar to which the plates converge. These patents and the Pembroke patent disclose various lever and linkage arrangements for coordinating movements of the venturi plates and for coordinating movement of metering movement of the venturi plates. However, none of these patents discloses the use of a pivotally mounted cam to actuate a needle valve to control fuel flow. The venturi plates disclosed in the Mick patent are not actuated directly by air flow, but by a diaphragm. This patent discloses a rotationally mounted cam; however, the cam is used to provide a fast idle position for the throttle rather than to actuate a fuel metering valve.

The publication *Aircraft Engine Maintenance* discloses a carburetor having pivotal quadrants which pivot toward a spray nozzle to form a variable venturi and a "cam-lever mechanism" to coordinate the movement of a metering needle therewith. However, the quadrants are not planar and are throttles governing air flow rather than themselves being actuated by air flow. In their closed position, the quadrants cover the fuel discharge orifice in the bar. Neither this publication, or the previously cited patents disclose any specific structure on the spray bar in the area engaged by the pivotally mounted elements in the closed positions, the bar being smooth in this area. The balance of the cited patent and other cited publications disclose structure even less relevant to this feature of the subject invention.

The Winfield U.S. Pat. No. 1,893,920, and the Fish U.S. Pat. No. 2,236,595, each disclose a carburetor having a spray bar provided with a row of discharge orifices transverse to the flow of air through a mixing passage. However, neither of these carburetors employs an air valve actuated by air flow. The carburetor of the Winfield patent has a fixed venturi and that disclosed in the Fish carburetor has a single row of such orifices disposed in one side of a pivotally mounted combined throttle and spray bar.

The Bickhaus et al U.S. Pat. No. 3,249,346, is believed relevant in its disclosure of an air valve carburetor employing a metering needle movable axially in a submerged metering orifice and in its showing of a pivotally mounted cam. However, the cam is utilized as in the Mick patent, supra, to fast idle condition, and is not functionally related to the needle. This carburetor is not otherwise relevant, having a single variable venturi and a diaphragm or "servo motor" actuated air valve.

The publication *Carburetors & Carburetion* is believed relevant in its disclosure of a carburetor having a pivoting cam to actuate a metering pin in an air valve carburetor. Although the disclosure is diagrammatic, the carburetor evidently has no other similarity to that of the subject invention.

It should be noted that none of the carburetors described in the patents and publications employ a pivoting cam whose pivot is selectively movable to provide manual adjustment of the air-fuel mixture ratio supplied by the carburetor.

DESCRIPTION OF THE PREFERRED EMBODIMENT

Figure 2:
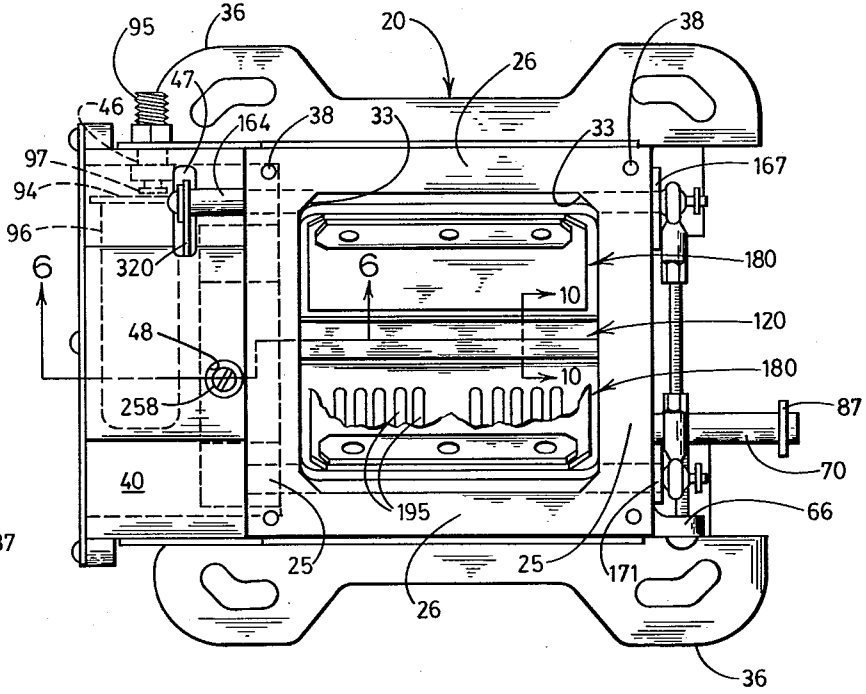
FIG. 2 is a top plan view of the carburetor of FIG. 1.

Referring with greater particularity to the drawings, in FIGS. 1 through 4 is shown a carburetor embodying the principles of the present invention. The carburetor is of the downdraft type and has a unitarily constructed housing 20. The housing has two substantially vertical planar end walls 25 and two substantially vertical planar side walls 26 disposed so as to define an upright mixing passage 28. The passage is substantially square, the end walls being one pair of opposite walls of the passage and the side walls being the other pair of opposite walls of the passage. The passage has an upper or upstream end 30 and a lower or downstream end 31. The carburetor is adapted for connection to an internal combustion engine, not shown, which, in a well-known manner, draws a flow of air through the passage from its upstream end toward its downstream end in a direction of flow 32 generally parallel to the walls. The upstream portion of the passage has beveled corners 33. The downstream portion is slightly enlarged transversely of the flow direction and has arcuate corners 34. The length of the passage parallel to the flow direction is substantially greater than its width. The housing has a planar flange 35 circumscribing the downstream end of the passage. The flange has four slotted lugs 36 extending individually from each corner of the passage for mounting the carburetor on the engine. The housing has four screw threaded bores 38 spaced about the upper end of the passage for mounting an air filter or the like on the carburetor in a well-known manner.

The housing 20 includes four planar walls 40 extending from one of the end walls 25 in a rectangular configuration forming a rectangular box 41 which is open oppositely of this end wall. The upper of these four walls is substantially horizontal and has a central hump 43. One of the vertical walls is provided with a screw threaded bore 46 extending through it horizontally. The portion of the upper wall between this vertical wall and the hump has a slot 47 extending parallel to the end wall and spaced somewhat toward it from the horizontal bore, as best shown in FIG. 2. The hump is provided with a circular opening 48 spaced oppositely therein from this bore and adjacent to said end wall.

The end walls 25 have individual bores 50, best shown in FIGS. 3 through 7, substantially centered between the side walls 26 and substantially equal in diameter. These bores are aligned about a horizontal axis 51 substantially normal to the end walls and disposed somewhat above the midpoint of the passage 28. The diameter of these bores is approximately one-third of the distance between the side walls. Each bore is circumscribed by a boss 52 disposed oppositely of the corresponding end wall from the passage. The one of these bores in the wall from which the box 41 extends opens into the box in downwardly adjacent relation to the upper one of its walls 40. The boss corresponding to this bore is provided with a pair of screw threaded bores 53, best shown in FIG. 5, parallel to this bore and disposed diametrically oppositely thereof at substantially the same elevation as the axis 51.

Each of the end walls 25 has a pair of upper bores 60 extending through it adjacent to the upper end 30 of the passage 28 and spaced equally therefrom. All of these bores are substantially equal in diameter. The pair of bores in the opposite end walls adjacent to each of the side walls is aligned about an axis 56 which is parallel to the axis 51. The upper bores are substantially above the box 41. The pair of these bores opposite this box are circumscribed by individual bosses 57 projecting from their respective end wall oppositely of the passage.

Each of the end walls 25 has a pair of lower bores 60 extending therethrough upwardly of the lower end 31 of the passage 28. The bores are individually equally spaced from the side walls a distance of approximately one-fourth of the width of the passage. Each pair of these bores in the opposite end walls equally spaced from the same side wall is aligned about an individual axis 61 parallel to the axes 51 and 56. The lower bores are somewhat larger in diameter than the upper bores and the lower bores in the end wall from which the box 41 extends are somewhat larger in diameter than those in the opposite end wall. Each of these large diameter bores is provided with a cup 64 which closes off access to the box and has an internal diameter substantially equal to that of the bore aligned therewith.

Figure 1:
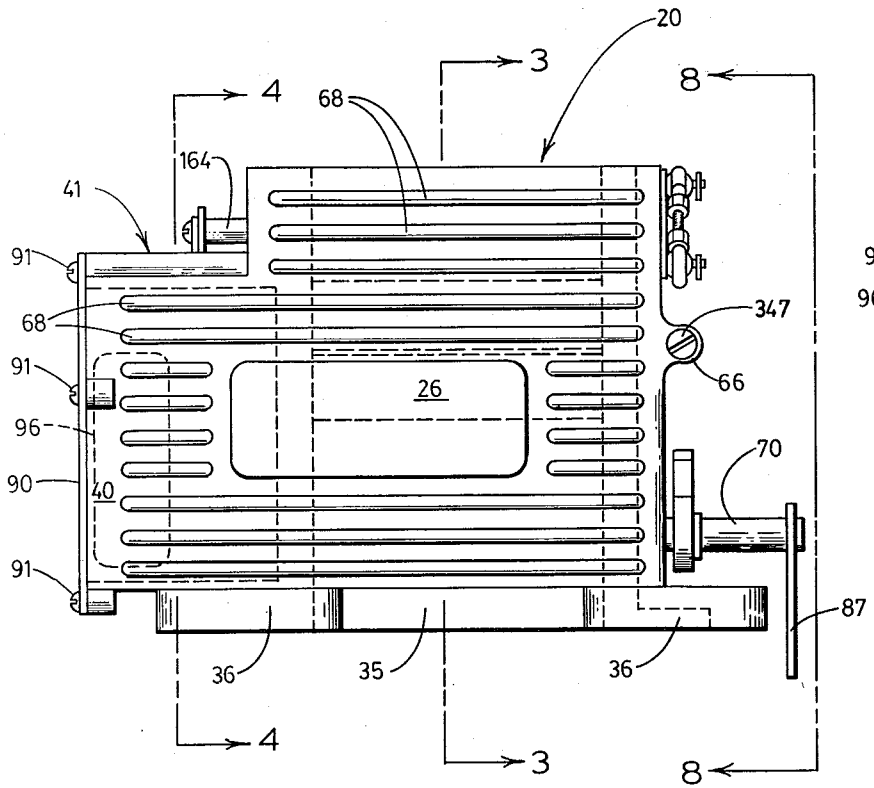
FIG. 1 is a side elevation of a carburetor embodying the principles of the present invention.
Figure 8:
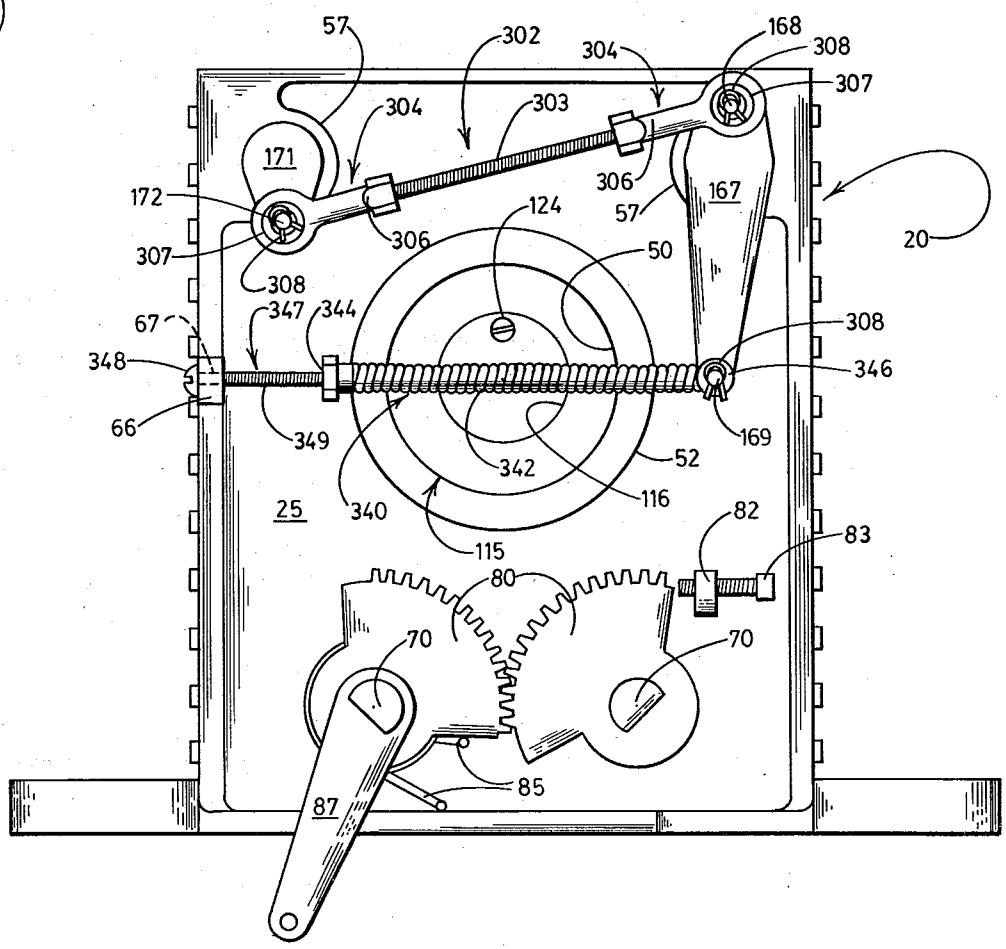
FIG. 8 is an end elevation of the carburetor at the same scale as FIG. 6 taken on line 8—8 of FIG. 1.

The one of the end walls 25 opposite the walls 40 has a lug 66, best shown in FIGS. 1, 2 and 8, extending therefrom away from the mixing passage 28. The lug is aligned with one of the side walls 26 opposite the bore 46 and is provided with a screw threaded bore 67. The axis of the bore is horizontal and substantially normal to the axis 51.

The exterior surfaces of the side walls 26 and of the pair of walls 40 which lie in the same plane are, typically, provided with a plurality of ribs 68.

Each aligned pair of the bores 60 is provided with a shaft 70 extended therethrough and individually journaled in the corresponding cup 64 and in the one of the bores opposite thereto. Each shaft projects somewhat oppositely of the passage from the bore not provided with the cup. The portion of each shaft between the end walls 25 has a slot 71 extending diammetrically through it. A substantially rectangular throttle or throttle plate 73 is extended through each of these slots and secured therein by a pair of screws 74. The plates have a width somewhat greater than one-half of the width of the passage and are substantially equal in length to the width of the passage. Each plate is longitudinally aligned with its respective shaft. The corners of the plates adjacent to the side walls 26 and arcuate so as to mate with the corners 34 in the passage 28. The longitudinal edges 75 of each plate are spaced substantially equally from the shaft and the sides of the plate converge slightly in a direction from the shaft toward these edges. The plates pivot with their respective shafts between an open position 76, best shown in FIG. 3, in which they are suostantially parallel to the side walls 26 and a closed position 77, rotated approximately ninety degrees therefrom. In the closed position, one of the longitudinal edges of each plate engages the corresponding side wall and the other longitudinal edge engages the corresponding edge of the other plate.

Each shaft 70 has a sector gear 80 mounted thereon for rotation therewith oppositely of the adjacent end wall 25 from the passage 28. The sector gears are enmeshed so as to synchronize the movement of the throttle plates between their open position 76 and closed position 77. The one of the gears opposite the lug 66 pivots toward a tab 82 extending from the housing. An idle speed screw 83 screw threadably engages the tab and extends through it toward this gear so as to engage it when the throttle plates are near their closed positions. The screw thus adjustably holds the plates slightly open in idle positions shown in dash lines in FIG. 9, and indicated by the numeral 84. A spiral spring 85 circumscribes the boss 62 adjacent to the gear opposite the tab 82. The opposite ends of the spring extend radially from the boss into individual engagement with the housing 20 and the gear so as resiliently to urge the throttle plates toward their closed positions. The shaft mounting this gear extends from it oppositely of the passage 28 and is provided with an arm 87 for connection to an accelerator pedal or other throttle control, not shown.

Figure 4:
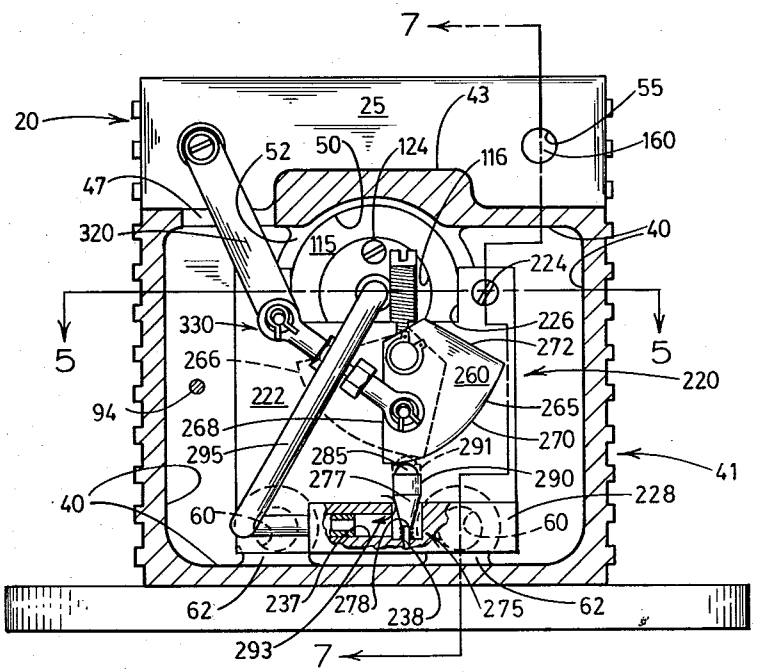
FIG. 4 is a vertical section of the carburetor taken at the same scale as FIG. 3 on line 4—4 of FIG. 1.

As best shown in FIGS. 2, 4, and 8, the carburetor has a planar cover 90 closing the open end of the box 41 of the housing 20 and secured thereto by a plurality of screws 91. This cover, the walls 40, and the adjacent one of the end walls 25 define a fuel supply or float chamber 93. A pin 94 extends from the end wall within the chamber parallel to the axis 51 and is disposed somewhat below the bore 46. A tube fitting 95 is screw threadably engaged with this bore and is adapted for connection to a suitable source of fuel under pressure, not shown. A float 96 is pivotally mounted on the pin adjacent to the cover and is spaced substantially from the adjacent one of the end walls. The float actuates a needle value 97 within the fitting in a well-known manner to maintain a substantially constant level 98 of fuel in the chamber.

Figure 6:
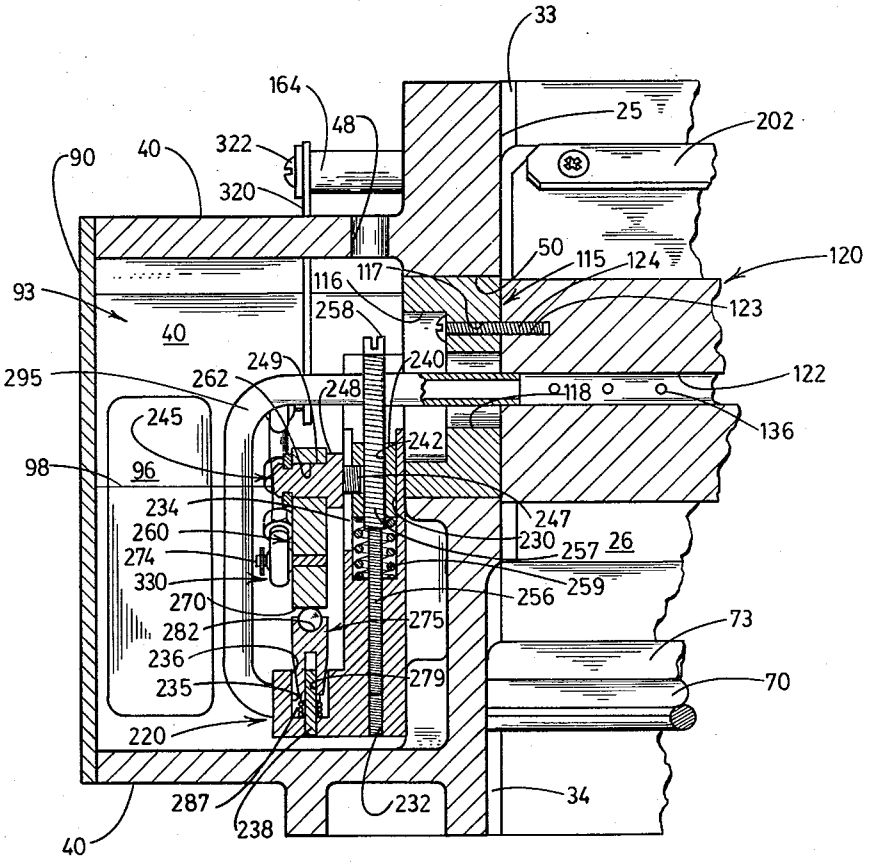
FIG. 6 is a fragmentary vertical section at an enlarged scale taken on line 6—6 of FIG. 2.
Figure 5:
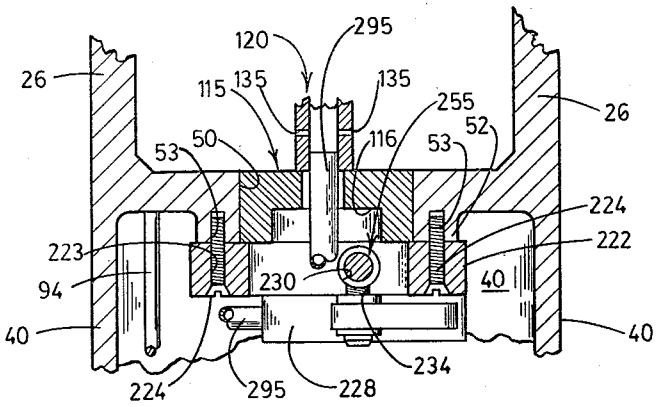
FIG. 5 is a fragmentary section taken from the position of line 5—5 of FIG. 4.

As best shown in FIGS. 3 through 7, the carburetor includes a pair of discs 115 individually fitted peripherally in fluid-tight relation into the central bores 50 of the end walls 25. Each disc has a central circuit recess 116 in its side opposite of the passage and a relatively small bore 117 extending parallel to the axis 51 from the recess into the passage. The side of each disc disposed toward the passage is substantially flush with the corresponding end wall so as to serve as a portion thereof. The one of the discs adjacent to the chamber 93 has its side disposed toward the chamber substantially flush with the corresponding boss 52, as best shown in FIG. 6. This disc has a central cylindrical bore 118 extending through it about the axis 51.

The carburetor has a fuel spray bar 120, best shown in FIGS. 2, 3, 6, 10, and 12, mounted on the discs 115 and extended therebetween transversely across the mixing passage 28. The bar is elongated along the axis 51 and is thus parallel to the axes 56 and 61. The bar has a central bore 122 whose axis substantially coincides with the axis 51. This bore extends through the bar from its longitudinal end disposed toward the chamber 93 nearly to the opposite end. Each of the longitudinally opposite ends of the bar is provided with a screw threaded bore 123 extended therein parallel to the central bore and aligned with the corresponding one of the bores 115 in the discs. A screw 124 extends through each aligned pair of bores and fixedly secures the bar to the discs.

Figure 3:
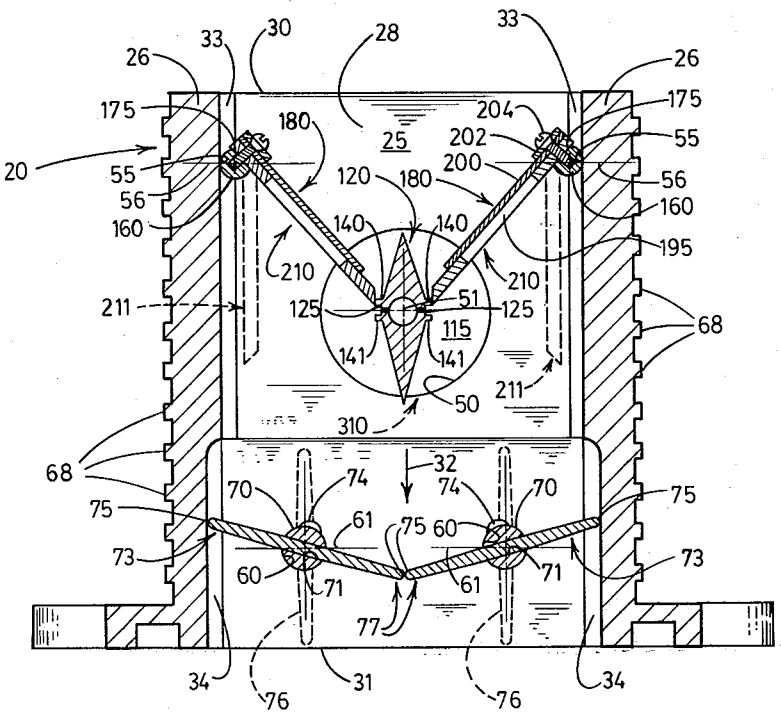
FIG. 3 is a vertical section of the carburetor at an enlarged scale taken on line 3—3 of FIG. 1 showing a pair of venturi plates and a pair of throttle plates in closed positions with fully open positions shown in dash lines.
Figure 10:
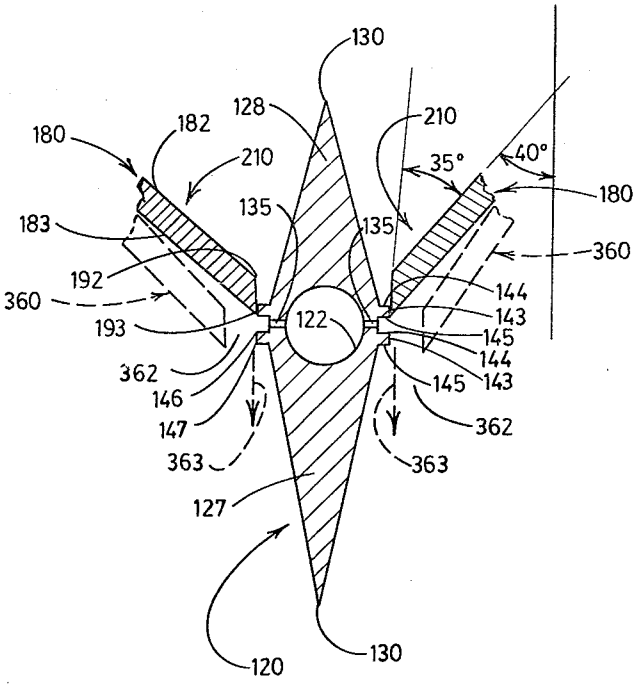
FIG. 10 is a fragmentary section of the venturi plates and a spray bar at a greatly enlarged scale taken on line 10—10 of FIG. 2 showing the plates in their closed positions with idle positions shown in dash lines.

The spray bar 120 has a pair of transversely opposite surfaces 125 spaced from the axis 51 toward the side walls 26. The surfaces are equally spaced from the axis so that the bar is centrally disposed in the passage and equally spaced from the side walls. Each surface is disposed in parallel spaced relation to the corresponding side wall. The distance between the surfaces is such that the area of the bar in a plane normal to the direction of flow 32 and containing said axis is approximately one-tenth of the area of the passage normal to the flow direction. The bar thus has a downstream wedge-shaped portion 127 and an upstream wedge-shaped portion 128 which extend to individual apices 130 centered between the side walls. As best shown in FIGS. 3 and 10, these wedge-shaped portions are of equilaterally triangular cross section. The downstream portion preferably extends substantially farther downstream from the surfaces than the upstream portion extends upstream therefrom.

The bar 120 is provided with a plurality of fuel discharge orifices 135 extending from the surfaces 125 into the bore 122 about axes normal to the side walls 26. The orifices are spaced along a pair of rows 136 individual to and disposed centrally of the surfaces and extended parallel to the axis 51. The orifices thus open into the mixing passage in a direction normal to the flow direction 32 with the orifices of each row being disposed toward the corresponding side walls.

Figure 7:
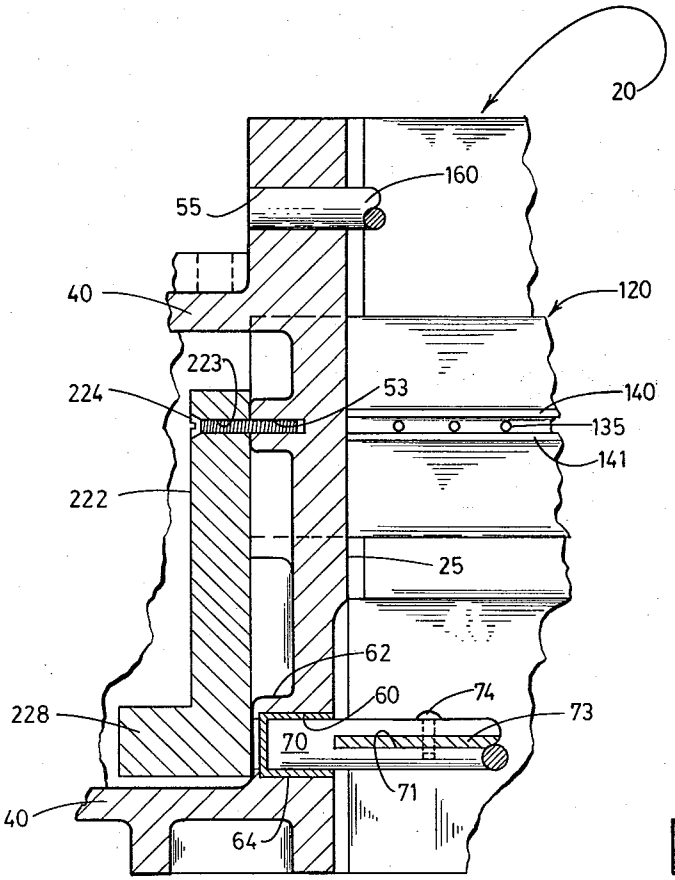
FIG. 7 is a fragmentary section taken on line 7—7 of FIG. 4 at the same scale as FIG. 6.

Each of the surfaces 125 has an upstream ridge or spoiler 140, best shown in FIGS. 3, 7, and 10, disposed upstream of the corresponding row 136 of orifices 135 and has a downstream wedge-shaped spoiler ridge 141 disposed downstream of the row. The ridges extend along the surfaces 125 parallel to the axis 51 between the discs 115. The ridges project from the surfaces transversely of the passage 28 toward their respective side walls 26 and constitute corrugations. The spoilers are closely adjacent to the orifices and are of substantially rectangular cross section. Each ridge has a first planar side 143 parallel to the side walls and the surfaces and spaced from the respective surface of the bar a distance in the range of 0.01 to 0.05 inch (0.25 to 1.25 mm.), and preferably 0.015 inch (0.38 mm.). Each ridge has a second planar side 144 and a third planar side 145 disposed oppositely of the first side and extending normally from it to the corresponding surface 125 of the bar. The second side is upstream of the third side and these surfaces intersect with the first side in respective linear shape edges 146 and 147. The width of the ridges of each surface in the direction of flow and their spacing in this direction are substantially equal and are approximately equal to the distance between the first sides and the surface of the bar.

As best shown in FIGS. 3, 4, and 7, each aligned pair of bores 55 has a shaft 160 extended through them for rocking movement about respective axes 56. As best shown in FIGS. 1, 2, 6, and 11, each shaft extends somewhat outwardly of the bores in the end wall 25 opposite to the float chamber 93 to an axial end 162. The one of the shafts adjacent to the slot 71 extends axially from the adjacent end walls to an axial end 164 disposed above the slot and provided with a screw threaded, coaxial bore 165.

As best shown in FIGS. 8 and 10, the one of the shafts 160 having the bore 165 in its end 164 is provided with an arm 167 secured to its opposite axial end for pivotal movement with the rocking action of the shaft. The arm extends radially in opposite directions from the shaft, having a shorter portion provided with a pivot pin 168 and an opposite longer portion provided with a pivot pin 169. These pins are parallel to the shaft. The pin on the longer portion is spaced from the shaft a distance approximately equal to the distance the axis 51 is spaced vertically below the axes 56. The pin on the shorter portion is spaced axially from the shaft approximately one-third of this distance. The other of the shafts 160 is provided with a radially extended arm 171 secured thereto for movement therewith. The arm has a pivot pin 172 parallel to the shaft and spaced from it a distance equal to the spacing between the pin 168 and its respective shaft.

Each of the shafts 160 has a planar mounting surface 175 disposed parallel to a diameter of the shaft and extended longitudinally of the shaft between the end walls 25. The surfaces are so disposed that, when the pins 168 and 172, respectively, are substantially vertically above and below the corresponding axes 56, the surfaces are in planes converging toward the spray bar 120 and substantially intersecting the downstream edge 147 of the corresponding upstream spoiler ridge 140. The relative spacing of the bores 50 and 55 is such that, with the surfaces so disposed, the lesser included angle between each surface and the corresponding side wall 26 is approximately 40°.

Figure 11:
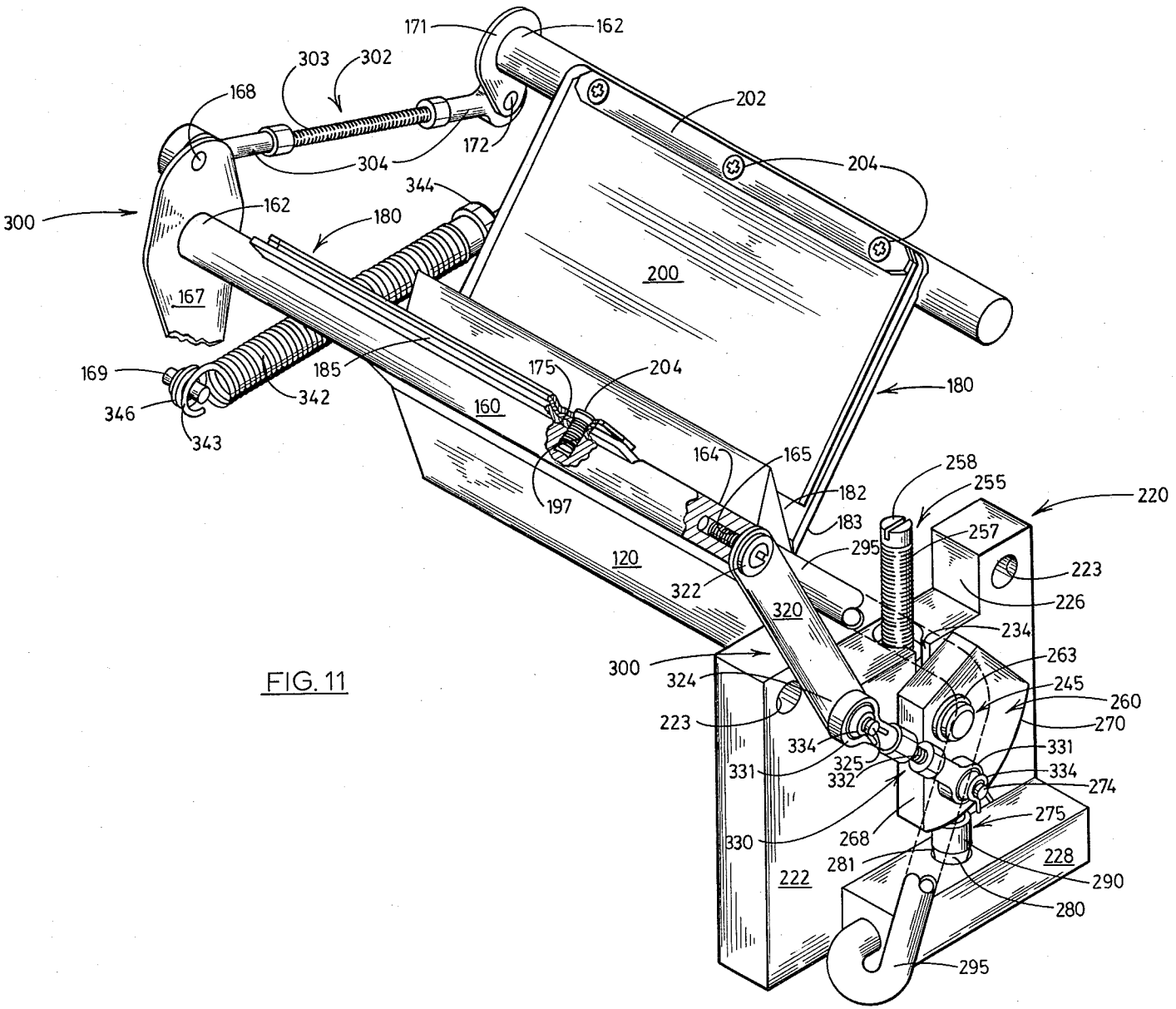
FIG. 11 is a perspective view of certain movable elements of the carburetor with portions broken away for illustrative convenience, showing their disposition with the venturi plates in their closed positions.

The carburetor has a pair of generally rectangular venturi plates 180, best shown in FIGS. 2, 3, and 11, mounted on the surfaces 175 of the shafts 160 for pivotal movement with the shafts about the axes 56. Each plate has a planar first side 182 which confronts the spray bar 120 and an opposite, parallel planar second side 183. Each plate has a mounting edge 185 extending parallel to the corresponding axis 56 and has an opposite planar distal edge 190. The distal edge is elongated in a direction parallel to the axis 51 and is obliquely related to the sides of the plate. The angle between the distal edge and the first side is somewhat less than the lesser included angle between the corresponding surface 175 and the wall 26 described in the previous paragraph. The angle between the distal edge and the first side is substantially 35° when said lesser included angle is substantially 40°. The distal edge has a linear upstream margin 192 where it intersects the first side and a linear downstream margin 193 where it intersects the second side. The length of each plate in a direction parallel to its respective shaft is substantially equal to the length of the corresponding mounting surface. The plate is disposed on this surface with the portion of its second side adjacent to its distal edge flatly engaged with the surface.

Each plate 180 has a plurality of parallel, elongated, transversely spaced slots 195 opening through it between its sides 182 and 183. The slots extend longitudinally in a direction normal to the mounting edge 185. Each plate has a plurality of mounting bores 197 extending normally between its sides adjacent to its mounting edge and spaced therealong. A rectangular, flexible flap 200 is mounted on the first side 180 of each plate. One edge of the flap is aligned with the mounting edge 185 of the plate and the length and width of the flap are sufficient to cover the slots 195 when the flap is flatly engaged with the first side. An elongated mounting plate extends along the mounting edge oppositely of the flap from the first side. A plurality of screws 204 extend through appropriate openings in the backing plate 202 and in the flap are individually through the bores 197 into screw threaded engagement with the corresponding shaft 160, clamping the plate and the flap onto the venturi plates and fixedly mounting these elements on the shafts.

As best shown in FIGS. 3, 10, and 11, the proportions and dimensions of the venturi plates 180 are such that, with the shafts 160 in their previously described positions with their surfaces 175 in planes convergent toward the spray bar 120, the distal edge 190 of each plate engages the first side 143 of the corresponding upstream spoiler 140. When so engaged, the downstream edge 147 of the ridge is aligned with the downstream margin 193 of the distal edge. When so engaged, the plates are in a first or closed position, identified by the numeral 210, in which they substantially close the mixing passage 28. In this position, the plates are convergent downstream to the bar with their distal edges adjacent to the orifices 135 therein and are extended approximately parallel to the surfaces 125 and to the side walls 26. The plates are oppositely pivotable about the axes 56 between their closed positions and second or fully open positions identified by the numeral 211 and depicted in dash lines in FIG. 3. In the open positions, the plates are retracted from the bar and extend in a downstream direction from their respective shafts with their sides 182 and 183 substantially parallel to the side walls 26 and to the flow direction 32.

The carburetor has a fuel value assembly 220, best shown in FIGS. 4 through 7 and 11, mounted within the chamber 93 on the corresponding one of the end walls 25 between this wall and the float 96. The assembly has a generally rectangular, vertical mounting plate 222, which is parallel to the end walls 25. A pair of bores 223 extend individually through the upper corners of the plate and are spaced so as to be aligned with the bores 53 in the boss 52. The plate is mounted on the boss with its edges substantially parallel with the walls 40 with the lower edge of the plate disposed in parallel adjacent relation to the lower of these walls. The plate is secured to the boss by a pair of screws 224 which extend individually through each pair of aligned bores and are screw threadably engaged with the boss. The thickness of the plate is such that the extended axis of the circular opening 48 is disposed approximately midway between the sides of the plate. The upper edge of the plate has a notch 226 centrally between the screws for access to the bore 118 in the adjacent disc 115. The plate includes a unitary valve body 228 which is a substantially square rectangular prism projecting from the side of the plate oppositely of the boss a distance approximately equal to the thickness of the plate. The body extends horizontally along the lower edge of the plate from its vertical edge opposite to the slot 47 beyond the midpoint of this lower edge.

The plate 222 is provided with a cylindrical bore 230 extending vertically downward therein from the notch 226. This bore is approximately aligned with the opening 48. The bore extends from the notch to a point centrally of the plate where it is intersected by a coaxial screw threaded bore 232 of substantially smaller diameter. The axis of these bores is substantially parallel to the end walls 25. A vertically elongated slot 234 having vertical, parallel sides extends from the side of the plate having the valve body 228 into the cylindrical bore. The slot is diametrically aligned with this bore and extends parallel thereto from the notch nearly to the screw threaded bore.

The valve body 228 has a vertical inlet bore 235 extending from its upper surface nearly to its lower surface. The axis of this bore lies substantially in a plane normal to the mounting plate 222 and contains the axes of the bores 230 and 232. The bore defines a circular inlet opening 236 in the valve body where the upper end of the bore opens into the chamber 93. The valve body has an outlet bore 237 extending through it horizontally from the lower portion of the vertical bore into the chamber 93 in a direction toward the one of the walls 40 having the fitting 95. A cylindrical pin 238 is mounted on the body and extends upwardly within the vertical bore in coaxial relation thereto.

The valve assembly includes a cylindrical crosshead or journal element 240 slidably fitted within the bore 230. The crosshead has a coaxial screw threaded bore 242 which is aligned with the screw threaded bore 232 in the valve body and is somewhat larger in diameter. The screw threads in these bores are of the same direction but are of different pitch. For example, the larger bore has a "¼-28" right-hand screw thread and the smaller has a "6-32" right-hand screw thread. The crosshead has a unitary journal 245 extended from it through the slot 234. The axis of the journal is substantially right-angularly related to the axis of the bores 230 and 232, to the axis of the bore 235 and its opening 236, to the end walls 25. The axis of the journal is, therefore, substantially parallel to the axes 51, 56, and 61. The journal has a screw threaded axial end 247 which extends through the slot and is screw threadably engaged with the crosshead. The journal is, thereby, secured to the crosshead for slidable movement with it in a direction parallel to the axes of the bores 230, 232, and 235. The journal has an annular collar 248 which is slidably engaged with the plate 222 outwardly of the slot. The journal includes a cylindrical bearing surface 249 which extends axially from the collar oppositely of the slot above the opening 236 in the valve body 228.

The valve assembly 220 includes a differential screw 255 having a lower axial end portion provided with a screw thread 256 mating with the screw threaded bore 232 in the plate 222, a central portion having a screw thread 257 mating with the screw threaded bore 242 in the crosshead 240, and a slotted upper axial portion or head disposed in downwardly adjacent relation to the opening 48. The head is thus accessible through the opening from a position externally of the chamber. A helical compression spring 259 is disposed within the bore 230 in coaxial relation to the screw between the lower end of this bore and the lower end of the crosshead 240. The spring bears resiliently and oppositely against these ends and urges the crosshead upwardly in relation to the plate 222. The spring thus causes the axial clearance between the screw and the screw threads mating therewith to be taken up by upward movement of the crosshead relative to the screw and by upward movement of the screw relative to the plate.

The valve assembly 220 includes a cam 260 rotationally mounted within the chamber 93 on the journal 245. The cam has a bore 262 rotationally fitted over the bearing surface 249 and is retained on the journal in a well-known manner by a snap-ring 263. The cam has a first extreme pivotal position 265 shown in solid lines in FIG. 4 and an opposite second such position 266 shown in dash lines. The cam has a planar edge 268 with, in the first position, lies in a vertical plane spaced somewhat toward the pin 94 from the journal and the inlet opening 236.

The cam 260 has a convex cam surface 270 disposed toward the opening 236 and extended from the lower end of the planar edge 268 above the opening and away from the pin 94 to an edge 272 of the cam which has any suitable shape and extends generally toward the bore 262, returning to the planar edge. The cam surface is generally arcuate and is eccentrically related to the axis of the bore 262. The point at which the cam surface intersects the edge 268 is spaced farther from said axis than the point at which the surface intersects the edge 272. The point on the cam surface intersected by the axis of the inlet opening 236 when the cam is in its first position is thus spaced closer to the opening than is the corresponding point on the surface when the cam is in its second position. The spacing between such a point and the opening progressively increases as the cam rotates in a direction from its first position 265 toward its second position 266 and progressively decreases as the cam rotates in the opposite direction.

The cam 260 has a pivot pin 274 parallel to its bore 262 and disposed centrally between the bore and the portion of the cam surface 270 adjacent to the edge 268.

The valve assembly 220 includes a valve 275 received in the bore 235 of the body 228 for movement axially therein. The valve has a lower frusto-conically tapered portion 277 disposed within the inlet opening 236 with the smaller diameter end 278 downwardly disposed. This portion has a coaxially related bore 279 extending upwardly therein. This bore is slidably fitted over the pin 238 to maintain the valve in coaxial alignment with the inlet opening. This opening and the tapered portion of the valve define an annulus 280 therebetween. The valve has a unitary upward extension or plunger 281 terminating in a concave spherical socket 282 which faces the cam surface 270 and rotationally receives a ball 285. A helical spring 287 is loosely fitted about the pin and bears oppositely against the valve and the body, urging the valve and plunger toward the cam surface so that the ball is engaged therewith.

The valve 275 has a first extreme position, shown in FIG. 11 and in solid lines in FIG. 4. The valve has an opposite second extreme position shown in dash lines in FIG. 4. These positions correspond, respectively, to the first position 265 and second position 266 of the cam 260. When these elements are in their first positions, the valve nearly closes the opening 236 so that fuel flow, indicated by the arrow 293, from the supply chamber through the opening is relatively restricted by the valve due to the relatively small area of the annulus 280. When the cam is in its second positions, the point on the cam surface 270 intersected by the axis of the bore is spaced upwardly farther than in their first positions so that the spring urges the valve upwardly into its second position in which only its smaller diameter end 278 is within the opening and the flow of fuel is relatively unrestricted by the valve. The cam is thus in controlling association with the valve. Due to the tapered shape of the valve, the restriction thereto decreases progressively as the valve moves in a direction from its first position toward its second position and increases progressively during movement in the opposite direction.

The valve assembly 220 includes a tube 295, best shown in FIGS. 4, 6, and 11, interconnecting the outlet bore 237 of the valve body 228 with the central bore 122 in the spray bar 120. The opposite ends of the tube are received, respectively, in fluid-tight relation within these bores. In order to clear other elements within the chamber 93, the tube has a first horizontal portion extending from the valve body to a short second horizontal portion. This second portion extends normally from the first portion toward the float 96 to a third portion. The third portion extends in turn upwardly from the second portion toward the axis 51 to a fourth portion which is received in the spray bar. The bores 235 and 237 in the valve body, the tube, and the bore 122 in the bar define a conduit interconnecting the fuel supply chamber 93 and the fuel discharge orifices 135 for fuel flow therebetween in a direction from the chamber toward the orifices. The opening 236 thus serves as an inlet opening through which fuel is supplied from the chamber to the conduit past the valve, and the valve is extended into the conduit through the opening so as to control the flow of fuel into the conduit from the chamber.

The carburetor has a control linkage indicated generally by the numeral 300 and best shown in FIGS. 2, 4, 8, and 11. The linkage has a first link or pitman 302 interconnecting the respective pins 168 and 172 of the arms 167 and 171. The pitman has a central shank 303 having male screw threads and substantially identical opposite end portions 304. Each end portion has an internally screw threaded portion 306 engaged with the shank and a ball joint 307 fitted to the corresponding pin. The pitman is retained on each pin by a spring clip 308 engaging the pin outwardly of the corresponding ball joint. It is, of course, desirable for the venturi plates 180 to pivot equally and oppositely upon actuation of the linkage. Since the pitman 302 is connected to the arm 171 below its pivot shaft 160 and to the arm 167 above its pivot shaft 160 precisely equally and oppositely, pivoting of the plates is best achieved if the spacing of the pin 172 and the shaft 160 is slightly longer than the spacing of the pin 168 and its shaft 160. Since the arms extend oppositely from their respective shafts, the movement of the plates is in opposite directions although coordinated so that the angles between the plates and their corresponding side walls 26 are equal at all positions of the plates. The plates thus define a distendable and contractible venturi or throat 310 through which the spray bar 120 extends. The plates thus adjust the size of the throat and regulate the effective size of the mixing passage 28.

The control linkage 300 includes a lever 320 mounted on the end 164 of one of the shafts 160 by a screw-and-washer assembly 322 for pivotal movement with rocking action of the shaft. Since the movement of this shaft is coordinated with that of the other of the shafts by the pitman 320, the pivotal movement of the lever is coordinated with the distension and contraction of the throat 310. The lever extends radially from the shaft through the slot 47 toward the cam 260 to a distal end 324 which is adjacent to the cam. The distal end is provided with a pivot pin 325 extending from it parallel to the shaft toward the float 96. The distal ends of this pin and the pin 274 in the cam 260 are aligned in a direction parallel to the end walls 25 and these pins are interconnected by a second or push-pull link 330. This link is similar to the pitman 302, having opposite end portions 331 provided with individual ball joints and screw threadably engaged with a central shank 332. The end portions are retained on their respective pins by individual sparing clips 334. The link interconnects the lever and the cam so that they and the shafts 160 and venturi plates 180 have concurrent, corresponding movements. As best shown in FIG. 11, the linkage 300 connects the cam and plates so that the closed positions 210 of the plates correspond to the first position 265 of the cam and to the first position 290 of the valve. The opposite, open position 211 of the plates corresponds to the opposite, second positions 266 and 291, respectively, of the cam and the valve. As a result, opposite rotational movement of the cam restricts and constricts the throat 310 and, correspondingly, opens and closes the valve.

The carburetor includes a return assembly 340, best shown in FIGS. 8 and 11, which interconnects the lug 66 of the housing and the pin 169 of the arm 167. The assembly has a resilient, helical, tension spring 342. One end of the spring is provided with an eye 343 which is fitted over the pin, and the opposite end has an internally screw threaded nut 344 mounted coaxially thereon. The nut is secured to the spring in any suitable manner, as by welding. The eye is retained on the pin by a washer and spring-clip assembly 346. The return assembly includes a screw 347 having a head 348 and a screw threaded shank 349. The shank is extended through the bore 67 in the lug into screw threaded engagement with the nut with the head bearing on the lug oppositely of the nut. The return assembly resiliently urges the pin in a direction toward the lug. As the pin moves in this direction, the arm 167 is pivoted so as to move the corresponding one of the venturi plates 180 toward the spray bar 120. Since the movement of the plate and the cam 260 are coordinated, as previously described, the spring urges the plates toward their closed positions 210 and the cam toward its first position 265. The force exerted by the spring to urge these elements in the manner described can be increased or decreased, respectively, by rotating the screw 347 to move the nut toward or from the lug 66.

OPERATION

The operation of the described embodiment of the present invention is believed to be clearly apparent, and is briefly summarized at this point.

When an internal combustion engine to which the carburetor is connected is not running, no air is being drawn through the passage 28 so that atmospheric pressure prevails within the passage and the venturi plates assume their closed positions 210 shown in FIGS. 3, 10, and 11, under the urging of the spring 342. As previously described, in this position the plates close the passage just above the fuel discharge orifices 135. As a result, when the engine is cranked for starting, the full vacuum developed by cranking the engine exists below the plates and is applied to the orifices, drawing a relatively large amount of fuel through them and creating a necessary "choking condition" for starting the engine.

Figure 9:
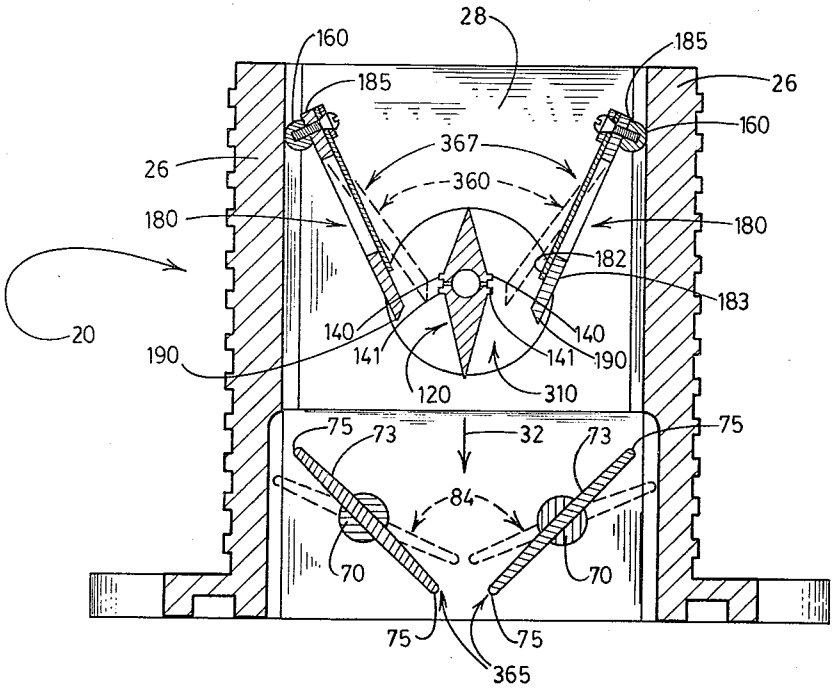
FIG. 9 is a view similar to FIG. 3, showing the plates in intermediate positions with idle positions shown in dash lines.

When the engine is running in an idle condition, the throttle plates 73 are in their idle position 84, shown in dash lines in FIG. 9 and restrict the flow of air through the passage 28 so that the engine runs at idle speed. This flow of air induces a sufficient pressure differential across the venturi plates 180 to pivot them somewhat from their closed positions 210 into idle positions 360 shown in dash lines in FIGS. 9 and 10, in which the throat 310 is only slightly distended. Since the venturi plates have retracted only slightly from the surfaces 125 of the spray, however, the orifices 135 open into the narrowest portion of the throat where the air velocity is highest, and by Bernoulli's principles, the pressure is lowest. Since the pressure in the chamber 93 above the fuel level 98 is atmospheric, fuel from the chamber is urged to flow in succession through the opening 236 past the valve 275, the bores 235 and 237, the tube 295, the bore 122, and the orifices into the mixing passage.

It will be noted that, with the venturi plates 180 in their idle positions 360 in which they are nearly closed, each of their distal edges 190 is substantially parallel and adjacent to the corresponding surface 125 of the spray bar 120 defining a channel 362 with parallel sides therebetween. This parallel condition is due to the angle between each distal edge 190 and the corresponding side 182 being somewhat less than the lesser included angle between each plate and the corresponding side wall 26 when the plates are in the closed positions 210. As a result, when the plates pivot somewhat from their closed position into the idle position, their distal edges are brought into substantially parallelism with the spray bar surfaces and the side walls. Air flow in the idle condition is thus parallel to these surfaces and normal to the orifices 135 as indicated by the dash arrow 363 in FIG. 10 ensuring that the highest possible pressure differential exists to meter fuel flow from the chamber to the orifices. In the idle position of the venturi plates, the control linkage 300 causes the cam 260 and valve 275 to assume corresponding positions very close to their first positions, so that fuel flow past the valve is nearly as restricted as in the closed position.

Since, as just described, the fuel flow is very restricted in the idle condition, very precise axial positioning of the valve 275 is required in relation to the opening 236 to allow for individual differences in the engine and the like. The valve assembly 220 provides for selective and precise adjustment of this position by varying the spacing between the axis of the journal 245 about which the cam 260 rotates, and the opening. Raising or lowering the journal a predetermined distance raises or lowers the cam an equal distance. The spring 287 maintains the valve in engagement with the cam as it is raised and lowered so that movement of the valve is precisely equal to movement of the journal. Therefore, with a given shape of the cam surface 270, the extent of opening and closing of the valve incident to rotation of the cam is regulated by raising and lowering the journal.

The journal 245 is moved parallel to the axes of the bores 230 and 235 by rotation of the differential screw 255. The movement of the journal can be precisely controlled since, due to the action of the screw threads 256 and 257, one rotation of the screw only moves the journal axially the difference between the pitches of the screws. In the exemplary embodiment, one rotation of the screw in a clockwise direction, as viewed through the opening 48, lowers the screw a distance of 1/32 of an inch. However, this same rotation raises the journal 1/28 of an inch in relation to the screw. The journal thus moves upwardly the difference between these distances, only a little over 4/1000 of an inch (approximately 1/10 mm.). In the idle condition, therefore, the fuel flow can be precisely adjusted in relation to the air flow. This precision adjustment also defines a base point for the relative positions of the valve 275 and inlet opening 236 in relation to other positions of the venturi plates 180.

If, with the venturi plates 180 in any position, a backfire occurs in the engine, the direction of flow through the passage 28 is reversed from the normal direction 32 and tends violently to urge the plates toward their closed position 210. However, in this event, the flaps 200 swing upwardly from the plates opening the slots 195 and allowing the reverse flow to escape through them. However, if during a backfire, the plates 180 are urged into their closed positions 210 against the spray bar 120, the plates 120 are not deformed by engagement with the spray bar 120, since, when these elements engage, their engaging portions, the distal edge 190 and the first side 143 of the ridge 140, are nearly parallel and are planar.

Figure 12:
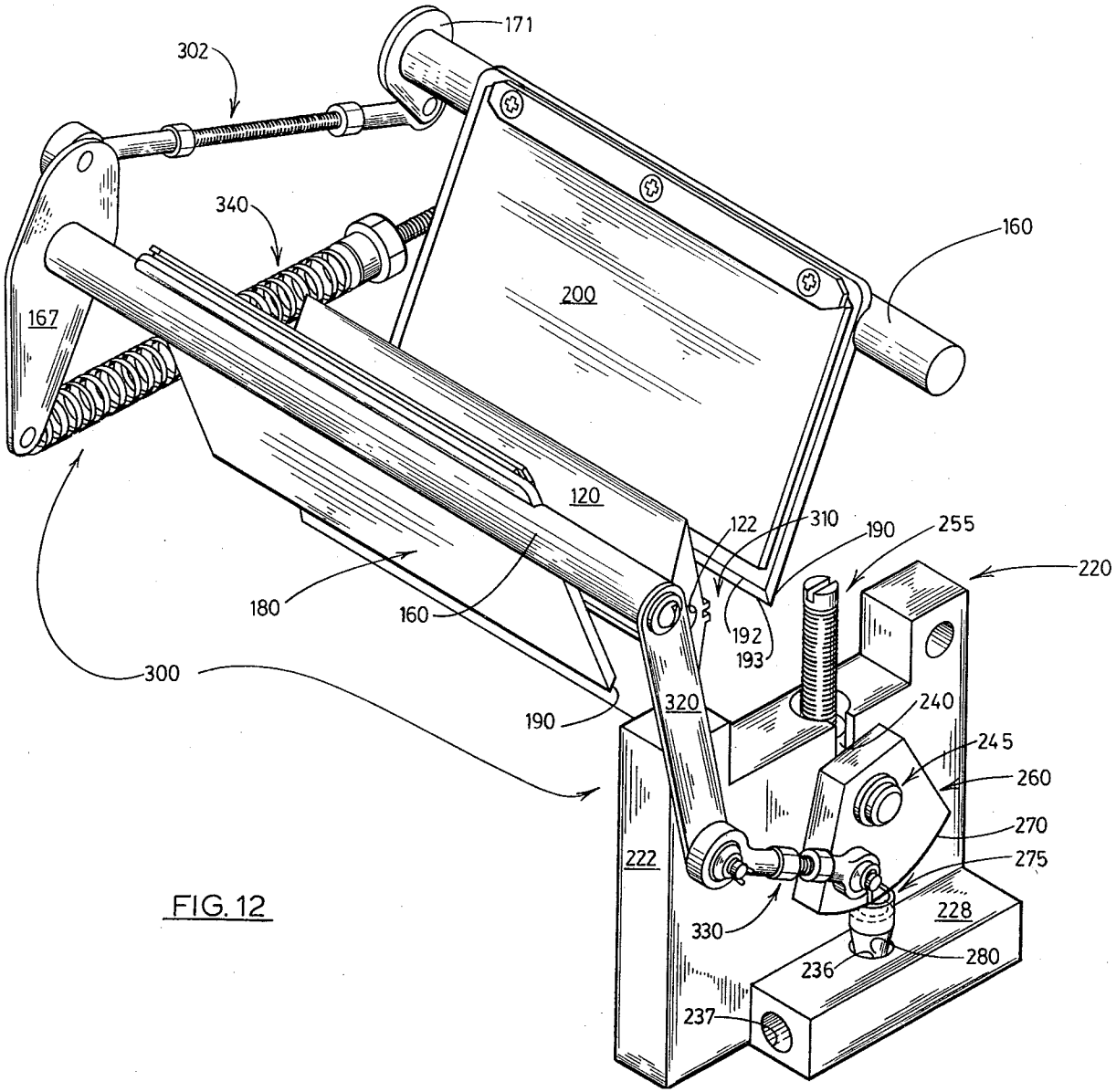
FIG. 12 is a view similar to FIG. 8 showing the disposition of the elements when the venturi plates are in their intermediate positions.

The air flow through the mixing passage 28 increases in the normal direction 32 from the air flow in the idle condition when the speed of the engine increases and/or when the throttle plates 73 are pivoted from their idle positions 84 somewhat toward their open positions 76 to intermediate positions 365 shown in FIG. 9. The increased air flow produces sufficient air flow across the venturi plates 180 to pivot them into an intermediate position 367, shown in FIG. 12 and in solid lines in FIg. 9, corresponding to the increased air flow. The relative position of the venturi plates thus corresponds to the relative air flow through the passage in the normal direction. Since, as previously described, the relative position of the valve 275 within the opening 236, and therefore the relative restriction to fuel flow between the chamber 93 and the mixing passage, corresponds to the relative pivotal position of the venturi plates, the valve regulates the airfuel mixture in the passage. The relative positions of the plates, the control linkage 300, and the movable elements of the valve assembly 220 corresponding to the closed positions of the plates are shown in FIG. 11. The relative positions of these elements with the plates in their intermediate positions are shown in FIG. 12. In particular, the increase in area of the annulus 280 as the venturi plates move from their closed positions into their intermediate positions, corresponding to the increase in area of the channels 362, should be noted.

As the venturi plates 180 move from their closed positions 210 through their idle positions 360 to their intermediate positions 367, their distal ends 190, which define the throat 310, move in an arcuate path transversely away from the bar 120 as well as in the flow direction 32. As a result, the throat remains adjacent to the fuel orifices 135 so that the point of highest air velocity in the passage 28 remains adjacent to the throat to take the fullest advantage of Bernoulli's principle for fuel metering. This positioning of the point of highest air velocity also causes fuel emerging from the orifices to break up into a fine spray so that the fuel is evenly distributed in the air as the mixture leaves the downstream end 31 of the passage. This relation of of the distal ends to the orifices as the plates move initially from their closed positions is, of course, due to relative disposition of the spray bar in relation to the axes 56 and to the relative proportions of the plates so that the plates extend downstream from these axes in convergent relation to the bar in their closed positions.

The cam surface 270 can, of course, be constructed in any suitable shape to provide for differences in angular movement between the venturi plates 180 and cam 260, differences in air flow characteristics due to the varying shape of the mixing passage 28 as the throat 310 distends and contracts, and differences in fuel flow characteristics at different axial positions of the valve 275 in the bore 235. Since the linkage 300 interconnects the plates and the cam so that they move simultaneously, the cam positions the valve to regulate the air-fuel ratio in the mixture supplied by the carburetor to the engine. As a result, a desired air-fuel ratio can be provided to the engine throughout the range of movement of the plates and the cam. The shape of the cam surface can be such as to provide a substantially constant air-fuel ratio in the mixture supplied by the carburetor or to provide a relatively richer mixture when the plates are near their idle positions 360 and/or their fully open positions 211.

Since the cam surface 270 is convex and is formed on the periphery of the relatively compact cam 260, this surface is easily and economically machined to give a precise shape which results in the desired air-fuel ratio characteristics over a wide range of air flow through the mixing passage 28. If a change in these characteristics is desired or if the carburetor is to be connected to an engine of a different type, it is only necessary to replace the cam with another having a cam surface of different optimum shape. Such a change is relatively inexpensive due to the form of the cam and since it can be conveniently removed and replaced by sliding it along the journal 245 after removal of the snap ring 263. Any minor differences in the position of the cam surface in relation to the opening 236 due to manufacturing tolerances or wear can, of course, be corrected by adjusting the journal in relation to the opening 235 by rotation of the differential screw 255 in the manner previously described.

As air flow to the engine increases to its maximum value, the air flow pivots the venturi plates 180 into their fully open positions 211 shown in dash lines in FIG. 3. In such positions, the plates restrict the air flow 32 minimally since they are parallel to the side walls 26. When the plates are in this position, the distal ends 190 are disposed somewhat downstream of the fuel orifices 135. However, with the plates parallel to the side walls, the narrowest area of the passage 28 is between the spray bar 120 and the plates so that the point of highest velocity remains adjacent to the orifices.

At all positions of the venturi plates 180, the spoilers 140 and 141 create turbulence adjacent to their respective orifices 135 insuring effective distribution of fuel into the mixing passage 28. This turbulence is especially effective when the plates are in their idle positions 360 since the air velocity in the passage is relatively low during idling operation of the engine except at the throat 310. Under these circumstances, where the throat is relatively narrow and adjacent to the spoilers, this turbulence substantially fills the throat. However, as the air flow and the width of the throat increase, the turbulence is confined to the area around the orifices where it is advantageous and does not significantly limit maximum air flow through the carburetor.

The spoilers 140 and 141 also assist in providing even fuel distribution in the throat 310. The fuel orifices 135 are disposed along the bar 120 so that fuel is discharged evenly along the throat if the air flow is also even across the throat. The turbulence induced by the spoilers reduces motion of air in a direction along the bar, that is transversely of the overall air flow 32, so that the air flow is evenly distributed in the throat and the fuel is drawn equally from each orifice.

The spoilers 140 and 141 of each surface 125 not only have common functions, as just described, but serve individual functions. The upstream spoilers 140 serve to interrupt the air flow and give it the proper direction parallel to the orifices 135. These ridges also assist in providing the temporary enrichment required in acceleration. Since the orifices are "pocketed" directly beneath the upstream spoilers, small accumulations of fuel occur between the spoilers during idling. Thus, upon initiating acceleration, the fuel flow increases before the overall air flow can increase. The downstream spoilers 141 serve to shield the orifices from random pressure variations created downstream of the orifices. These disturbances, typically, are created by pulsations from opening and closing of intake valves of the engine and by turbulence resulting from angular positions of the throttle plates 73 such as those shown in FIG. 9. The downstream spoilers also serve as a ledge which retains small accumulations of fuel from the orifices, allowing these accumulations to be dissipated relatively gradually and evenly into air flowing through the passage 28 to an engine connected to the carburetor. It will be appreciated that the venturi plates 180 are responsive to air pressure variations so as automatically to compensate for altitude and barometric changes. If the ambient air pressure decreases, the venturi plates move in a closing direction and through the control linkage 300 to reduce the rate of fuel supply.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. In a carburetor adapted for connection to an internal combustion engine:

A. a housing having an elongated mixing passage adapted to have air drawn therethrough in a predetermined direction by the engine;

B. an elongated spray bar mounted transversely in the passage in substantially equally spaced relation to opposite sides thereof;

C. a pair of venturi plates;

D. substantially parallel shafts mounted in the housing on opposite sides of the spray bar, parallel thereto and upstream thereof individually mounting the venturi plates for pivotal movement between positions convergent downstream to the spray bar and positions pivoted outwardly from their convergent positions downstream on opposite sides of the spray bar, the spray bar having orifices therein oppositely disposed at positions adjacent to the venturi plates when in the convergent positions;

E. arms individual to the shafts oppositely radially extended from their respective shafts;

F. a pitman interconnecting the extended ends of the arms for concurrent opposite pivotal movement of the venturi plates;

G. resilient means urging the plates into their convergent positions;

H. a source of fuel under pressure;

I. a plunger actuated valve having an intake connected to the source and an outlet connected to the spray bar;

J. a cam;

K. a journal substantially parallel to the shafts mounting the cam for rotation adjacent to the valve, said cam having an eccentric convex cam surface in engagement with the plunger of the valve whereby opposite rotation of the cam opens and closes the valve;

L. means mounting the journal for adjustable movement toward and from the plunger of the valve whereby the extent of opening and closing of the valve incident to the cam rotation is regulated;

M. a lever extended from one of the shafts adjacent to the cam;

N. a push-pull link pivotally interconnecting the lever and the cam for corresponding rotational movement; and O. control means for rotating the cam to open and to close the valve in response to pivotal movement of the venturi plates to regulate the air-fuel mixture in the passage.

2. The carburetor of claim 2 in which the journal is releasable to render the cam replaceable.

3. In a carburetor adapted for connection to an internal combustion engine having: a housing including a pair of walls disposed oppositely of a mixing passage through which air is drawn by the engine and a fuel supply chamber; a throttle downstream of the passage; a pair of venturi plates mounted on the housing for pivotal movement about individual axes upstream of the throttle and individually adjacent to the walls, the plates extending from their respective axes into the passage for opposite movement between first positions in which the plates substantially close the passage and second positions in which the passage is relatively open; a fuel spray bar extending across the passage between the throttle and the axes and parallel to the axes, having a fuel discharge orifice opening into the passage; and a fuel conduit interconnecting the chamber and the orifice for fuel flow in a direction from the chamber toward the orifice, the improvement comprising:

A. a valve mounted within the fuel conduit for opposite movement between a first position in which the conduit is relatively closed by the valve and a second position in which the conduit is relatively open, the conduit being progressively opened as the valve moves from the first position toward the second position and being progressively closed as the valve moves in the reverse direction, the fuel conduit having a circular inlet opening within the fuel chamber; the valve having a frustoconical portion extended substantially axially into said opening and decreasing in diameter in the direction of fuel flow through the conduits;

B. a cam movably mounted on the housing having a cam surface whose spacing from a predetermined point of the conduit varies in controlled relation to said movement of the cam, the cam being rotationally mounted on the housing within the chamber with the cam surface disposed toward the opening; and said cam surface engaging means is an extension from the frustoconical member toward the cam, the movement of the cam being substantially right-angularly related to the axis of the inlet opening;

C. means engaging the cam surface and connected to the valve for movement thereof corresponding to the variation in said distance;

D. means connecting the cam and the venturi plates for concurrent corresponding movement of the valve between the first and second positions thereof as the plates move between their first and second positions and regulate the air-fuel mixture ratio provided by the carburetor, the carburetor further comprising means for varying the spacing between the axis of the cam and the opening including E. an element slidably mounted on the housing for movement along the axis of the opening and pivotally mounting the cam; and F. a differential screw having a pair of screw threads of the same direction and of different pitch, one of the screw threads being screw-threadably engaged with the housing and the other of the screw threads being screw-threadably engaged with the slidable element.

4. The improvement of claim 3 wherein the screw is accessible from a position externally of the housing.

5. In carburetor having a mixing passage through which air is drawn in a predetermined direction, an elongated fuel spray bar extended transversely of the passage having oppositely disposed orifices substantially aligned therealong, and a pair of planar venturi plates pivotally mounted in the passage on opposite sides of the spray bar for pivotal movement between a closed position convergent downstream to the spray bar and an open position retracted from the bar, elongated substantially straight extended edges defining a distendable and contractable throat therebetween with the spray bar disposed therein, and the plates having sides which confront the spray bar and the spray bar having sides which confront the plates, the bar having a device for causing turbulence in the throat to insure effective fuel distribution from the orifices particularly when the throat is contracted for idling operation comprising ridges extended along the confronting sides of the bar on opposite sides of the orifices and transversely of the passage, there being a ridge upstream from the orifices on each side of the bar against which the plates on their respective sides of the spray bar close when the throat is contracted.

* * * * *

UNITED STATES PATENT AND TRADEMARK OFFICE

CERTIFICATE OF CORRECTION

PATENT NO. : 4,283,355

DATED : August 11, 1981

INVENTOR(S) : William H. Herd, Jr., Stanley F. Curtis, Vernon T. Mullican, and Robert W. Jones It is certified that error appears in the above-identified patent and that said Letters Patent are hereby corrected as shown below:

Column 6, line 63, change "value" to ---valve---;

Column 7, line 1, change "circuit" to ---circular---;

Column 9, line 51, change "value" to ---valve---; and

Column 15, line 36, change "FIg." to ---FIG.---.

Signed and Sealed this

*Third* Day of *November 1981*

[SEAL]

*Attest:*

GERALD J. MOSSINGHOFF

*Attesting Officer*

*Commissioner of Patents and Trademarks*